United States Patent [19]

Okano et al.

[11] Patent Number: 5,049,930

[45] Date of Patent: Sep. 17, 1991

[54] SYSTEM FOR PREVENTING ERRONEOUS MOUNTING OF DEVELOPER TANKS ACCOMMODATED IN A DEVELOPING DEVICE

[75] Inventors: Tokiyuki Okano, Yamatokoriyama; Yoichi Shimazawa; Kazunori Sohda, both of Nara; Kiyoshi Inamoto, Sakai; Kazuyuki Ohnishi, Nara; Masato Tokishige, Yamatokoriyama, all of Japan

[73] Assignee: Sharp Kabushiki Kaisha, Osaka, Japan

[21] Appl. No.: 409,931

[22] Filed: Sep. 20, 1989

[30] Foreign Application Priority Data

Sep. 29, 1988 [JP] Japan ..... 63-244798

[51] Int. Cl.[5] ..... G03G 21/00

[52] U.S. Cl. ..... 355/206; 355/204; 355/326

[58] Field of Search ..... 355/206, 209, 326, 327, 355/260

[56] References Cited

U.S. PATENT DOCUMENTS

| | | | |
|---|---|---|---|
| 4,587,536 | 5/1986 | Saito et al. | 355/326 X |
| 4,611,899 | 9/1986 | Kasamura et al. | 355/260 |
| 4,697,915 | 10/1987 | Hayashi et al. | 355/327 |
| 4,814,823 | 3/1989 | Abuyama et al. | 355/208 |
| 4,839,691 | 6/1989 | Tagawa et al. | 355/260 |
| 4,841,336 | 6/1989 | Kusumoto et al. | 355/245 |
| 4,933,718 | 6/1990 | Furuya | 355/203 |

FOREIGN PATENT DOCUMENTS

| | | |
|---|---|---|
| 56-75670 | 6/1981 | Japan . |
| 61-292168 | 12/1986 | Japan . |

*Primary Examiner*—A. T. Grimley
*Assistant Examiner*—Christopher Horgan
*Attorney, Agent, or Firm*—Merchant, Gould, Smith, Edell, Welter & Schmidt

[57] ABSTRACT

An electrophotographic apparatus is provided with a developing device accommodating a plurality of developer tanks and a system for preventing erroneous mounting of these developer tanks. The developer tanks contain respective developers different in color from each other and are detachably mounted in respective predetermined mounting portions of the developing device. The system includes a connector formed on each of the developer tanks, a fixed connector formed on each of the mounting portions of the developing device and a controller for outputting at least one discrimination signal and judging whether or not the discrimination signal is inputted into the controller through at least one set of connectors. The connectors in each set are electrically connected with each other when each developer tank is properly mounted in its predetermined mounting portion of the developing device.

6 Claims, 2 Drawing Sheets

SYSTEM FOR PREVENTING ERRONEOUS MOUNTING OF DEVELOPER TANKS ACCOMMODATED IN A DEVELOPING DEVICE

BACKGROUND OF THE INVENTION

1. Field of the Invention

The present invention generally relates to an electrophotographic apparatus such as an electrostatic transfer type copier, a laser printer or the like, and more particularly, to a system for preventing erroneous mounting of a plurality of developing tanks accommodated in a developing device of an electrophotographic apparatus.

2. Description of the Prior Art

Conventionally, a developing device of a full-color copier, which is one of electrophotographic apparatus, is provided with a plurality of developer tanks accommodating respective developers in yellow, magenta, cyan and black. These developer tanks are required to be mounted in predetermined locations of the device, resulting from the construction of the copier. Accordingly, the conventional developing device is provided with a mechanism for mechanically preventing the developer tanks to be erroneously mounted in improper locations other than the predetermined locations. In this mechanism, the engagement structure of each set of the developer tanks and their respective mounting portions in the device differs from that of any other sets.

In such a conventional structure, however, since the developer tanks accommodating respective developers in yellow, magenta, cyan and black differ from one another in configuration, it is necessary to manufacture plural kinds of developer tanks for exclusive use with respect to respective colors, thus resulting in the increased number of parts, reduction in productivity followed by an increased cost.

SUMMARY OF THE INVENTION

Accordingly, the present invention has been developed with a view to substantially eliminating the above described disadvantages inherent in the prior art mechanism for preventing erroneous mounting of developer tanks accommodated in the developing device, and has for its essential object to provide an improved system which never permit erroneous mounting of a plurality of developer tanks having the same configuration.

Another important object of the present invention is to provide a system of the above described type which can reduce the number of parts of the developer tanks and can be readily provided in an electrophotographic apparatus at a low cost.

In accomplishing these and other objects, a system according to the present invention is applied to an electrophotographic apparatus provided with a developing device accommodating a plurality of developer tanks which contain respective developers different in color from each other and are detachably mounted in respective predetermined mounting portions of the developing device.

The system includes a first connector means formed on each of the developer tanks, a second connector means formed on each of the mounting portions of the developing device, and a discrimination means for outputting at least one discrimination signal and judging whether or not the discrimination signal is inputted thereinto through at least one set of the first and second connector means.

The first and second connector means are electrically connected with each other when each developer tank is properly mounted in its predetermined mounting portion of the developing device. In this event, a predetermined circuit is formed through the discrimination means and both the connector means so that a discrimination signal outputted from an output terminal of the discrimination means may be inputted into an input terminal of the discrimination means through the circuit. As a result, the discrimination means can detect the discrimination signal inputted thereinto and judges that each developer tank has properly been mounted in its predetermined mounting portion of the developing device.

In contrast, if a certain developer tank or tanks are mounted in improper mounting portions other than their predetermined mounting portions, no circuit is formed which communicates between the output and input terminals of the discrimination means. Accordingly, since no discrimination signal is inputted into the discrimination means, it is judged that the developer tanks have improperly been mounted in the developing device.

Since the system according to the present invention is of the above described construction, it is not necessary to manufacture plural kinds of developer tanks for exclusive use with respect to the color of developer to be contained therein and a plurality of developer tanks having the same configuration can be employed in the developing device.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
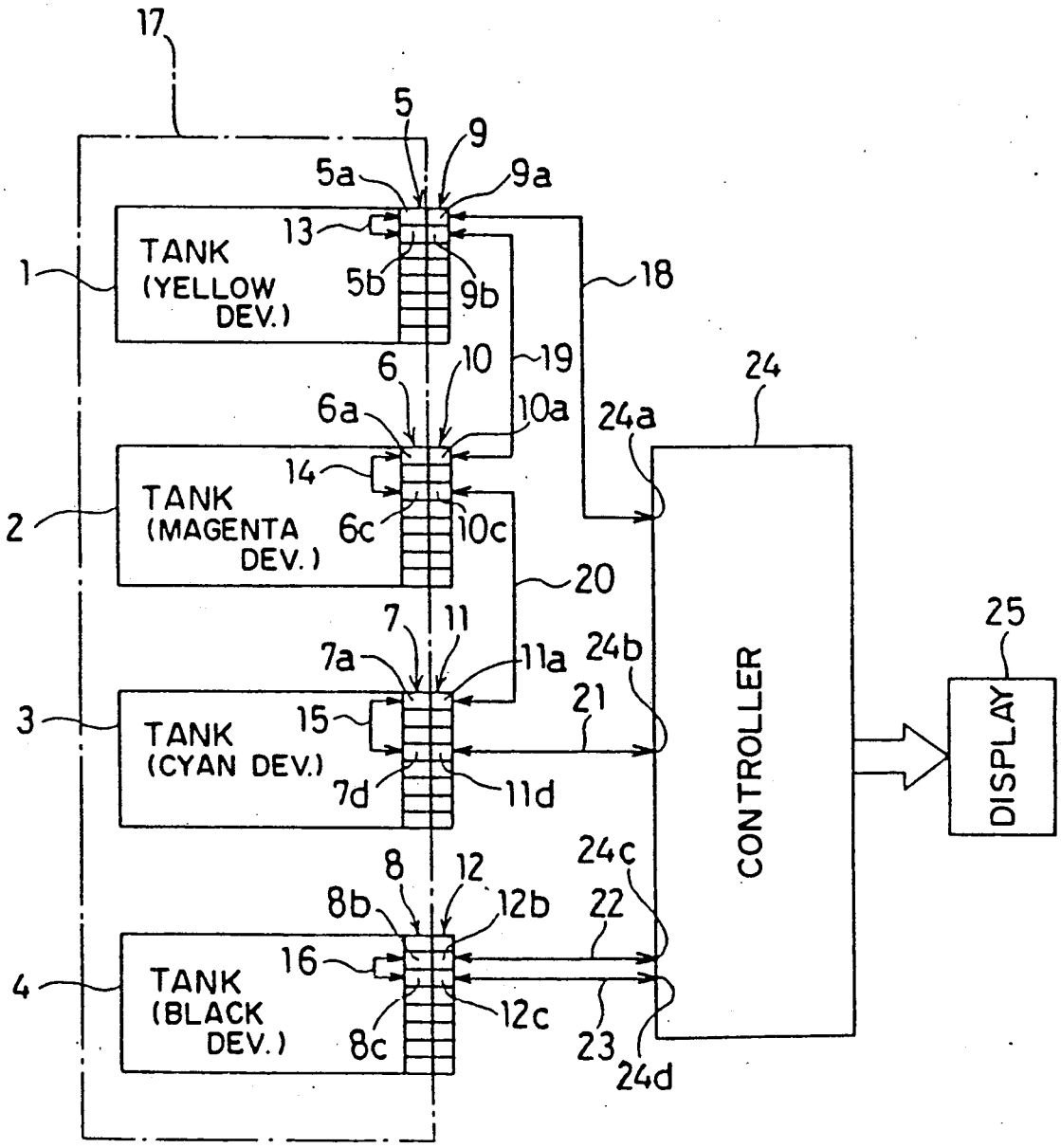
FIG. 1 is a schematic diagram of part of an electrophotographic apparatus provided with a system according to one preferred embodiment of the present invention for preventing erroneous mounting of developer tanks accommodated in a developing device.

Referring now to the drawings, there is schematically shown in FIG. 1, part of a copier which is one of electrophotographic apparatus and accommodates a developing device. The developing device is provided with a developing unit 17 accommodating a plurality of, for example, four developer tanks, a developer tank 1 containing yellow developer, a developer tank 2 containing magenta developer, a developer tank 3 containing cyan developer and a developer tank 4 containing black developer. The developer tank 1 is provided with a connector 5 having a plurality of connector pins including a first connector pin 5*a* and a second connector pin 5*b* while a mounting portion of the developing unit 7 for detachably mounting therein the developer tank 1 is provided with a fixed connector 9 having a plurality of connector pins including a first connector pin 9*a* and a second connector pin 9*b*. Likewise, the developer tanks 2, 3 and 4 are provided with respective connectors 6, 7 and 8 while corresponding mounting portions for detachably mounting therein these tanks 2, 3 and 4 are provided with respective fixed connectors 10, 11 and 12. The connectors 5 to 8 of the developer tanks 1 to 4 are brought into engagement with the fixed connectors 9 to 12 of the corresponding mounting portions of the developing unit 17.

The first and second connector pins 5*a* and 5*b* of the connector 5 are electrically connected with each other by a feeder 13. First and third connector pins 6*a* and 6*c* of the connector 6 are electrically connected with each other by a feeder 14. First and fourth connector pins 7*a* and 7*d* of the connector 7 are electrically connected with each other by a feeder 15. Second and third connector pins 8*b* and 8*c* of the connector 8 are electrically connected with each other by a feeder 16.

On the other hand, a first connector pin 9*a* of the fixed connector 9 is electrically connected by a feeder 18 with an output terminal 24*a* of a controller 24 which functions as a discrimination means while a second connector pin 9*b* of the fixed connector 9 is electrically connected with a first connector pin 10*a* of the fixed connector 10 by a feeder 19. A third connector pin 10*c* of the fixed connector 10 is electrically connected with a first connector pin 11*a* of the fixed connector 11 by a feeder 20. A fourth connector pin 11*d* of the fixed connector 11 is electrically connected with an input terminal 24*b* of the controller 24 by a feeder 21. A second connector pin 12*b* of the fixed connector 12 is electrically connected with an output terminal 24*c* of the controller 24 by a feeder 22 while a third connector pin 12*c* of the fixed connector 12 is electrically connected with an input terminal 24*d* of the controller 24 by a feeder 23. A display unit 25 for displaying whether or not each of the developer tanks 1 to 4 is properly mounted is electrically connected with the controller 24.

The controller 24 outputs two discrimination signals through the feeders 18 and 22. When the controller 24 receives these discrimination signals through the feeders 21 and 23, it judges that the developer tanks 1, 2 and 3 containing respective colored developers and the developer tank 4 containing black developer have been properly mounted in the corresponding mounting portions of the developing unit 17. In contrast, if the controller 24 does not receive at least one of the discrimination signals, it judges that some of the developer tanks 1 to 4 have erroneously been mounted, and this fact is displayed on the display unit 25.

In the above described construction, when the mounting conditions of the developer tanks 1 to 4 are judged after these tanks 1 to 4 have been mounted in the developing unit 17, the controller 24 outputs the discrimination signals to a group of developer tanks 1, 2 and 3 containing respective colored developers and to the developer tank 4 containing black developer through the feeders 18 and 22, respectively. When all of the developer tanks 1 to 4 are properly mounted in respective mounting portions of the developing unit 17, one of the discrimination signals outputted from the output terminal 24*a* of the controller 24 is inputted into the input terminal 24*b* of the controller 24 through the feeder 18, the first connector pin 9*a* of the fixed connector 9, the first connector pin 5*a* of the connector 5, the feeder 13, the second connector pin 5*b*, the second connector pin 9*b* of the fixed connector 9, the feeder 19, the first connector pin 10*a* of the fixed connector 10, the first connector pin 6*a* of the connector 6, the feeder 14, the third connector pin 6*c*, the third connector pin 10*c* of the fixed connector 10, the feeder 20, the first connector pin 11*a* of the fixed connector 11, the first connector pin 7*a* of the connector 7, the feeder 15, the fourth connector pin 7*d*, the fourth connector pin 11*d* of the fixed connector 11 and the feeder 21 in this order. The other on of the discrimination signals outputted from the output terminal 24*c* of the controller 24 is inputted into the input terminal 24*d* of the controller 24 through the feeder 22, the second connector pin 12*b* of the fixed connector 12, the second connector pin 8*b* of the connector 8, the feeder 16, the third connector pin 8*c*, the third connector pin 12*c* of the fixed connector 12 and the feeder 23 in this order. As a result, the improper mounting of the developer tanks 1 to is not displayed on the display unit 25 and an operator is informed of the proper mounting of these tanks 1 to 4.

Figure 2:
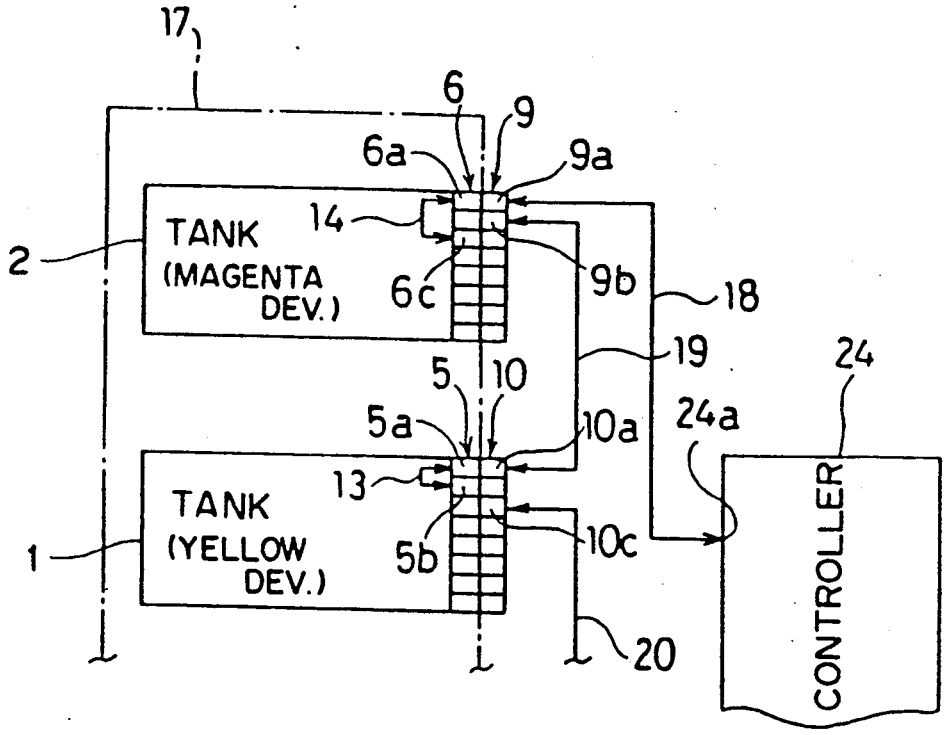
FIG. 2 is a fragmentary schematic diagram of FIG. 1 when two adjoining developer tanks are erroneously mounted in the developing device.

However, as shown in FIG. 2, if the developer tanks 1 and 2 have erroneously been mounted in the developing device in such a state that they change places with each other, only the electric connection through the feeder 18, the first connector pin 9*a* of the fixed connector 9, the first connector pin 6*a* of the connector 6, the feeder 14 and the third connector pin 6*c* is properly done but the third connector pin 6*c* and the second connector pin 9*b* of the fixed connector 9 are disconnected from each other. Accordingly, since the discrimination signal outputted from the output terminal 24*a* of the controller 24 can never be inputted into the controller 24, the controller 24 judges that the improper mounting takes place in the group of developer tanks 1 to 3 containing colored developers. This fact is displayed on the display unit 25 and imparted to the operator.

It is noted that even when either the group of developer tanks 1, 2 and 3 containing colored developers or the developer tank 4 containing black developer is mounted in the developing unit 17, the developing operation can be carried out in the developing device according to the present invention. For example, when only the group of developer tanks 1, 2 and 3 containing yellow, magenta and cyan developers, respectively, is mounted in the developing unit 17, the copying operation can be carried out in any desired color. In contrast, when only the developer tank 4 containing black developer is mounted in the developing unit 17, the copying operation can be carried out only in black and white.

As is clear from the foregoing, the system according to the present invention is advantageous in that a plurality of developer tanks each containing colored or black developer can be formed into the same configuration. Accordingly, not only the number of parts can be reduced but the productivity can be improved, resulting in a reduced cost.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A system for preventing erroneous mounting of a plurality of developer tanks accommodated in a developing device of an electrophotographic apparatus, said developer tanks containing respective developers which are different in color from each other and being detachably mounted in respective predetermined mounting portions of the device, said system comprising:

a first connector means formed on each of said developer tanks;

a second connector means formed on each of said mounting portions of the device;

said first and second connector means being electrically connected with each other when a developer tank is properly mounted in its predetermined mounting portion of the device;

interconnect means electrically connecting second connector means of one developer tank to second connector means for a different developer tank, wherein properly mounted developer tanks form a circuit; and discrimination means connected to said interconnect means for outputting a discrimination signal at one end of said circuit and receiving said signal at the other end of said circuit, wherein reception of said signal indicates the correct placement of developer tanks connected to said interconnect means.

2. The system according to claim 1, further comprising a display means for displaying whether said developer tanks are properly mounted in respective predetermined mounting portions of the device.

3. A system for preventing erroneous mounting of a plurality of developer tanks accommodated in a developing device of an electrophotographic apparatus, said developer tanks being detachably mounted in respective predetermined mounting portions of the device, said system comprising:

a first connector means including a plurality of connectors formed on each of said developer tanks;

a second connector means including a plurality of connectors formed on each of said mounting portions of the device, said first and second connector means configured such that mounting a developer tank properly in its predetermined mounting portion of the device forms a connection between a plurality of connectors on said second connector;

interconnect means connecting connectors from second connector means of a first developer tank to connectors of second connector means of a second developer tank, wherein when said first and second developer tanks are properly mounted said interconnect means forms a circuit; and discrimination means connected to said interconnect means for outputting a discrimination signal at one end of said circuit and receiving said signal at the other end of said circuit, wherein reception of said signal indicates the correct placement of developer tanks connected to said interconnect means.

4. The system according to claim 3 wherein said interconnect means connects a plurality of developer tanks and wherein reception of a discrimination signal inputted at one end of said interconnect means indicates the correct placement of developer tanks connected to said interconnect means.

5. The system according to claim 4 wherein said interconnect means electrically connects all color developer tanks.

6. A method of detecting developer tank mounting errors in an electrophotographic apparatus, comprising:

assigning each developer tank to one of a plurality of mounting connectors provided on said apparatus;

equipping each of said tanks with a signal jumper configured to form a signal path between predetermined signal pins of one of said mounting connectors when a tank is mounted to a mounting connector;

connecting signal pins of each of said mounting connectors such that each of said signal paths is connected in a circuit when each of said tanks is mounted correctly and in its assigned mounting connector; and checking for a complete circuit.

* * * * *